United States Patent [19]

Weikert

[11] 4,171,604

[45] Oct. 23, 1979

[54] METHOD AND APPARATUS FOR RETAINING ASEPSIS OF A STERILE WEB OF BAGS

[76] Inventor: Roy J. Weikert, 2000 Schlater Dr., Sidney, Ohio 45365

[21] Appl. No.: 886,921

[22] Filed: Mar. 15, 1978

[51] Int. Cl.[2] ..... B65B 55/04

[52] U.S. Cl. ..... 53/426; 53/167; 53/473

[58] Field of Search ..... 53/426, 473, 167

[56] References Cited

U.S. PATENT DOCUMENTS

| | | | |
|---|---|---|---|
| 3,340,671 | 9/1967 | Loo | 53/426 |
| 3,531,908 | 10/1970 | Rausing et al. | 53/426 |

*Primary Examiner*—Travis S. McGehee

*Attorney, Agent, or Firm*—Biebel, French & Nauman

[57] ABSTRACT

A method and apparatus for retaining asepsis of a sterile web of bags as the web is fed onto the filling pipe of a packaging machine. The filling pipe is covered by a special sterilizing boot and sterilized by directing steam or another sterilizing agent into the boot. The leading end of a sealed web of bags, the interior of which is sterile, is then attached to the boot adjacent the upstream end of the filling pipe with a sterilizing medium, such as hydrogen peroxide, interposed between opposed surfaces of the adjacent walls of the boot and web. The filling pipe has a barbed cone attached to its upstream end with which the adjacent walls of the boot and web are pierced so that the sterilized pipe is then positioned within the sterile web of bags without destroying the sterile condition of the pipe or the web. When the end of a web of bags is reached, the new web of bags is fed onto the filling pipe in a similar manner, except that the leading end of the new web of bags may be attached to the trailing end of the old web of bags in the same manner that the old web was attached to the boot.

8 Claims, 10 Drawing Figures

METHOD AND APPARATUS FOR RETAINING ASEPSIS OF A STERILE WEB OF BAGS

BACKGROUND OF THE INVENTION

Applicant's U.S. Pat. No. 4,021,283, dated May 3, 1977, discloses a method of making aseptic packaging. In accordance with this patent a web of bags is formed which consists of a plurality of interconnected, open-mouth bags having a continuous channel running across and communicating with the open mouths of the bags. The resulting system of interconnected bags and a channel extending across the bags in rendered sterile during the manufacturing process and, since the system is a closed, sealed system, this sterility can be maintained after the web of bags is formed, packaged and shipped to a filling and sealing station. Reference may also be had to Applicant's U.S. Pat. Nos. 3,813,845, dated June 4, 1974 and 3,941,306, dated Mar. 2, 1976.

The web of bags described above is particularly adapted to be used in conjunction with a packaging machine which includes an elongated filling pipe. The filling pipe is inserted in the channel running across the open mouths of the bags, and as the web of bags progresses along the filling pipe, filling material is deposited in the bags, the open mouths of the bags are closed by a relatively wide longitudinally extending heat seal, and the web of bags is separated from the filling pipe by severing the bag material in the area of the longitudinally extending seal closing the bag mouths. In this way, the bags can, in effect, be filled and sealed without exposing the bag interiors to ambient conditions.

However, it will be seen that a possible source of contamination of the sterile bag interiors arises as the filling pipe is initially inserted into the channel at the leading end of the web of bags. Thus, even though the conditions of manufacture are carefully controlled to insure the sterility of the interior of the web of bags, it will be seen that this aseptic condition can easily be destroyed as the web is fed onto the filling pipe of the packaging machine.

SUMMARY OF THE INVENTION

In accordance with the present invention a method and apparatus are provided for retaining asepsis of the interior of a sterile web of bags as the web is fed onto the filling pipe of a packaging machine.

Thus, in accordance with one aspect of the invention the asepsis of a sterile web of bags is retained as the web of bags is fed onto a pipe of a packaging machine by first enclosing the filling pipe with means which extends from an upstream end of the pipe to a point adjacent a downstream end thereof. While so enclosed the filling pipe is then sterilized. A leading end of a web of sterile bags is then attached to the enclosing means at a point adjacent the upstream end of the pipe. Facing exterior surfaces of adjacent walls of the enclosing means and the web of bags at their point of attachment to each other are sterilized and then the adjacent walls are punctured by the upstream end of the pipe to thereby position the upstream end of the pipe within the sterile web of bags.

In accordance with another aspect of the invention apparatus is provided for facilitating the retension of asepsis of a web of sterile bags as the web of bags is fed onto a filling pipe of a packaging machine. The apparatus includes an inner cone which terminates in a pointed end and is mounted adjacent an upstream end of the filling pipe, and means associated with the inner cone and movable with respect thereto selectively to cover and expose the pointed end of the inner cone.

More specifically, the filling pipe of a packaging machine is provided with a hollow pointed cone at the upstream end of the filling pipe and a hollow outer cone which is slidably mounted on the inner cone and spring urged to a position in which the pointed end of the inner cone is covered to prevent inadvertent puncturing of the web of bags as they move along the filling pipe.

A sterilizing fluid, such as sterile air, is pumped through a series of small diameter tubes which are mounted on and extend along the filling pipe and communicate with the interior of the inner cone. This both serves to produce a positive pressure within the web of bags during the filling and sealing process and to provide a blast of air as the web is first punctured to help separate the side walls of the web. The tubes may also be perforated at intervals along their lengths to provide a cushion of air to facilitate movement of the web of bags along the filling pipe.

Filling material passes from the filling pipe into the bags through a slot formed in the filling pipe adjacent its upstream end and a baffle is positioned within the pipe adjacent the opening and sealing the pipe against flow beyond the baffle. Additional tubes are provided for directing a sterilizing fluid, such as steam, into the area upstream of the baffle.

To further facilitate puncturing of the web of bags without piercing both side walls thereof, an adhesive tape with a tab attached to it may be adhered to one side wall of the web to pull that side wall away from the pointed end of the inner cone and prevent puncturing of that wall.

Sterilization of the facing exterior surfaces of adjacent walls of the pipe enclosing means and the web of bags may be accomplished by positioning an absorbent layer of material, such as a layer of foam plastic or an absorbent layer of paper, between the facing exterior surfaces and saturating this material with a sterilizing agent, such as hydrogen peroxide.

Thus, in accordance with the present invention the asepsis of a web of bags which has already been rendered sterile is retained as the web is fed onto the packaging machine filling pipe.

DESCRIPTION OF THE PREFERRED EMBODIMENTS

The present invention is particularly adapted to be used in packaging machinery of the general type shown in Applicant's three, above noted patents in which an elongated filling pipe is received within a channel extending across the open mouths of a series of bags.

Figures 1, 2, 3, 4, 5, 6:
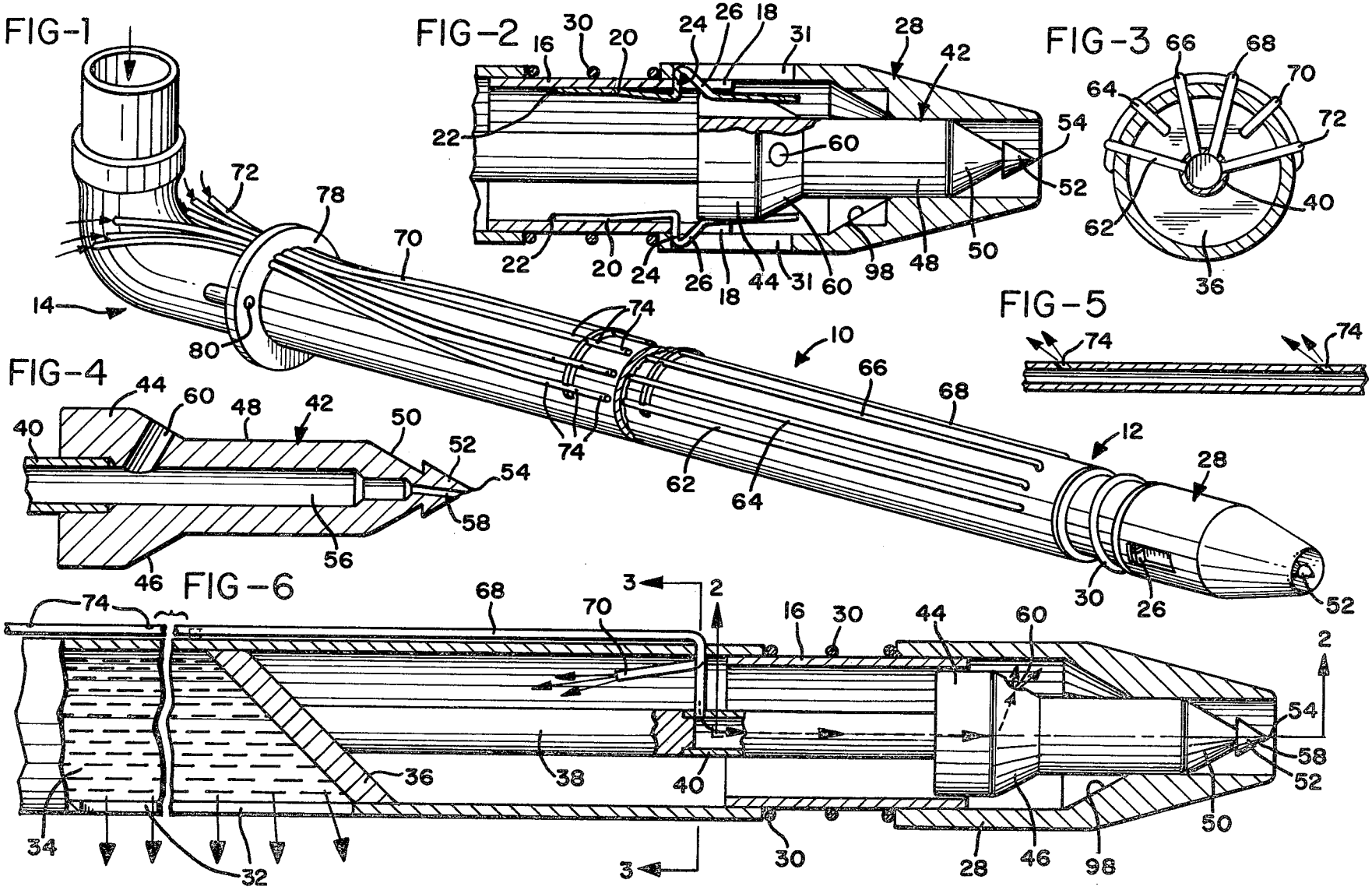
FIG. 1 is a perspective view of apparatus in accordance with the present invention.
FIG. 2 is an enlarged cross-sectional view taken on line 2—2 of FIG. 6.
FIG. 3 is a cross-sectional view taken on line 3—3 of FIG. 6.
FIG. 4 is a cross-sectional view through the inner cone of the present invention.
FIG. 5 is a cross-sectional view through one of the tubes associated with the filling pipe.
FIG. 6 is a cross-sectional view through the filling pipe and associated apparatus.

Turning first to FIG. 1 of the drawings, a filling pipe 10 is shown having an upstream end 12 and a downstream end 14. For purposes of reference throughout the application, the terms "upstream" and "downstream" shall refer to the direction of movement of the web of bags as they move along the filling pipe. Pipe 10, as seen in FIG. 6 of the drawings, is hollow throughout its length and is provided adjacent its upstream end with a ferrule 16 secured within the pipe by any convenient means, such as welding.

As seen in FIG. 2 of the drawings, the ferrule 16 is slotted on opposite sides as shown at 18 and leaf springs 20 are attached to the interior of the ferrule adjacent their downstream ends by welding or the like 22. Intermediate their ends the springs 20 are provided with a substantially right angle bend to define outwardly projecting portions 24 which extend through the slots 18, and an approximately 45° bend to form inwardly sloped cam surfaces 26.

An outer cone 28 is slidably received on the upstream ferrule 16 and urged in an upstream direction, to the right as seen in FIG. 2 of the drawings, by means of a coil spring 30 which encircles the ferrule 16 and bears at one end against the filling pipe 10 and at its other end against the end of the outer cone 28. Outer cone 28 provided with a pair of slots 31 which receive the outwardly bent portions 24 of the springs 22, which in turn bear against the downstream end of the slots 31 to retain the outer cone 28 on the ferrule 16. It will be seen that with this construction the outer cone 28 may be pushed downstream against the pressure of coil spring 30 or can be removed entirely from ferrule 16 by depressing the outwardly projecting portions 24 of the leaf springs 20.

The filling pipe 10 is provided, as best seen in FIG. 6 of the drawings, with a slot 32 through which filling material 34 passes out of the pipe and into the bags being conveyed along the pipe 10. A baffle 36 is disposed within the pipe 10 adjacent the opening 32 and sealing the pipe against flow beyond the baffle. A rod 38 is secured to the baffle 36 by, for example, welding and extends upstream to a point adjacent the upstream end of the pipe 10.

A tube 40 is attached to the rod 38 and an inner cone, referenced in its entirety by the numeral 42 (see FIG. 4 of the drawings), receives the upstream end of the tube 40. Inner cone 42 consists of a first cylindrical section 44 which receives the pipe 40 and is joined by a frusto-conical portion 46, which in turn is joined by a second cylindrical section 48. A second frusto-conical section 50 extends from section 48 and is joined by a barbed section 52 terminating in a sharply pointed end 54. The inner cone 42 is provided with a passage 56 which terminates in a small outlet 58 and has a second larger outlet 60 downstream of the outlet 58.

A series of tubes 62, 64, 66, 68, 70 and 72 extend longitudinally of the filling pipe 10 as best seen in FIGS. 1, 3 and 6 of the drawings. Tubes 62, 66, 68 and 72 communicate, as best seen in FIGS. 3 and 6 of the drawings, with the tube 40. Tubes 64 and 70 are reversely bent, as best seen in FIG. 6, and communicate with the space upstream of the baffle 36. Preferably tubes 62, 66, 68 and 72 will normally convey sterile air from any convenient source to the interior of the inner cone 42 from whence the air escapes through the openings 58 and 60. Additional openings 74, as best seen in FIGS. 1, 5 and 6, may also be provided in the tubes through which fluid may pass for a purpose to be described presently. Preferably the openings 74 are slanted in a downstream direction, as seen in FIG. 5 of the drawings.

Figures 7, 8, 9, 10:
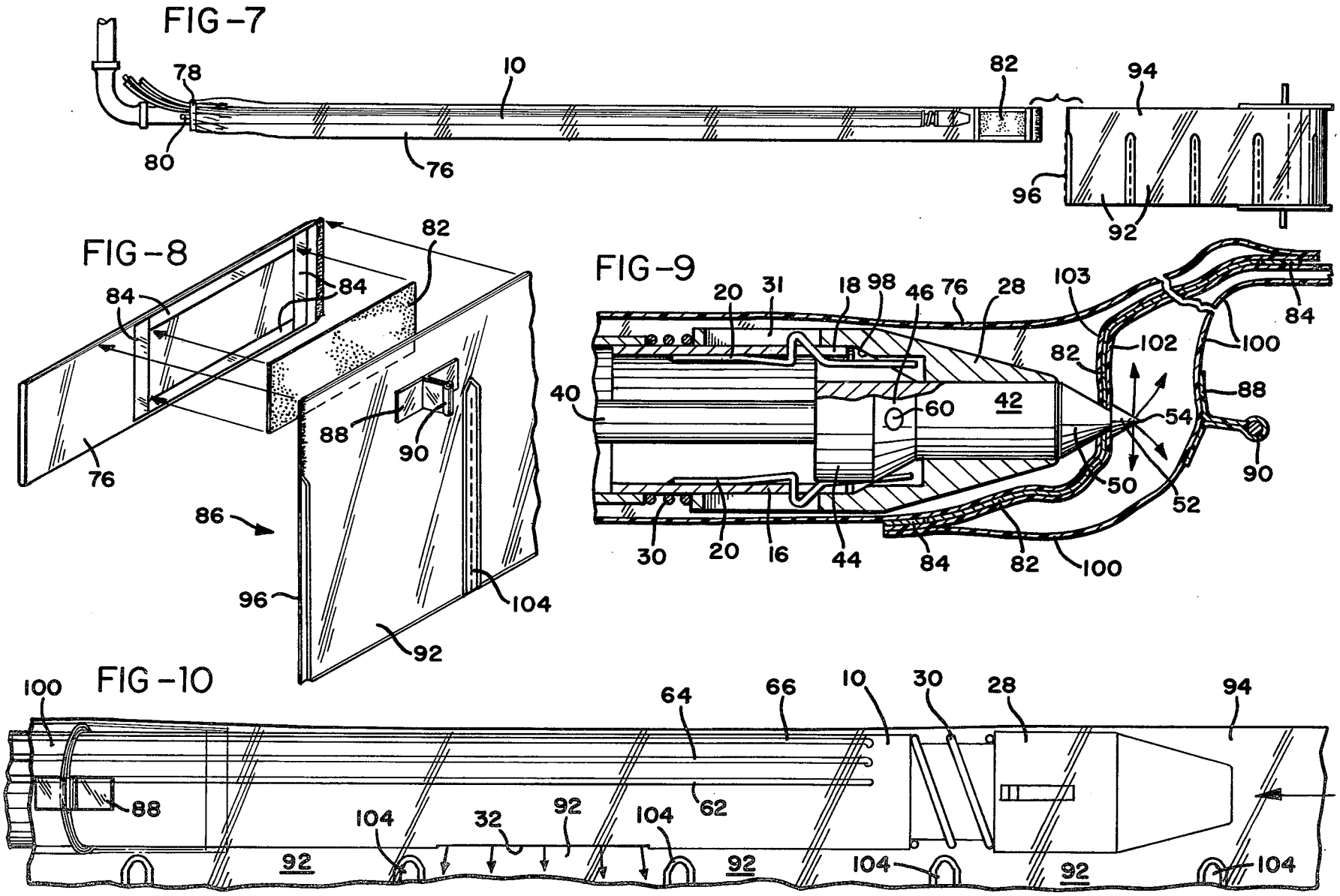
FIG. 7 is an elevational view showing a step in the method of the present invention.
FIG. 8 is a perspective view showing another step in the method of the present invention.
FIG. 9 is a cross-sectional view showing a further method step.
FIG. 10 shows a web of bags trained over the filling pipe of a packaging machine.

Turning to FIG. 7 of the drawings, in accordance with the present invention a closed end boot 76 is first placed over the filling pipe 10 and clamped by any convenient means to a ring 78 secured to the filling pipe adjacent its downstream end. Preferably a vent 80 is provided in the ring so that as a sterilizing medium, such as steam at 250° F., is pumped through the pipe 10 and the tubes 62 through 72 the boot will be filled with the sterilizing medium which then passes out of the boot through the vent 80. If required a larger diameter pipe (not shown) may be placed over the boot to resist the internal pressures in the boot and prevent bursting.

It will be apparent that appropriate valving, not shown, is associated with the filling pipe and each of the tubes extending along the filling pipe so that at start up sterilizing steam may be pumped through the filling pipe and through each of the tubes, but after sterilization has been accomplished, sterile air may thereafter by pumped through the tubes and filling material through the filling pipe 10. Such valving may be of conventional design and does not per se constitute the present invention.

A patch 82, as seen in FIGS. 7, 8 and 9 of the drawings, may be secured to the upstream end of the boot 76 by means of double sided tape 84 and the patch 82 is saturated with an appropriate sterilizing agent, such as a dilute solution of hydrogen peroxide. The leading end of the web of bags 86 is then adhered to the upstream end of the boot 76 with the saturated patch 82 between them and contacting their facing exterior surfaces. Tape 88 having an attached tab 90 may also be adhered to an outer wall of the web of bags 86 for a purpose presently to be described.

The web of bags, as best seen in FIGS. 7 and 8, consists of a series of open mouth bags 92 having a continuous channel 94 extending across their open mouths. The web of bags will have its leading edge 96 sealed and the interiors of the bags and the channel 94 will have been rendered aseptic by a method, such as that disclosed in Applicant's U.S. Pat. No. 4,021,283.

After the filling pipe has been sterilized by steam or the like the flow of steam through the system can be discontinued and sterile air instead pumped through the tubes 62 through 72. Such sterilizing air can vent through the vent 80, or the boot 76 can be unclamped from the ring 78 and sterilization will be maintained by the positive pressure and outward flow of sterile air through the downstream end of the boot.

With the web of bags attached to the boot as described above, the outer cone 28 is grasped through the boot and pulled backwardly against spring pressure toward the downstream end of the filling pipe. This exposes the sharply pointed end of the inner cone and the web and boot are then turned somewhat at right angles to the filling pipe, as seen in FIG. 9 of the drawings, and pulled against pointed end 54. As this is accomplished the tab 90 is pulled away from the inner cone to insure that the wall to which the tab is attached is not accidentally punctured.

As noted previously, sterilizing air is flowing through the tubes and initially out through the openings 58 and 60. However, when the outer cone 28 is moved to the position shown in FIG. 9 of the drawings an inner conical surface 98 thereof engages the frusto-conical surface 46 of the inner cone and shuts off the flow of air through the opening 60. This results in a greater flow of air through the opening 58, which tends to separate walls 100, 102 of the web and prevents inadvertent puncturing of wall 100 as the pointed end 54 is pushed through a wall 103 of the boot 76, the sterile patch 82 and wall 102 of the web of bags 86. The barb 52 insures that once punctured, the inner cone will not be accidentally withdrawn from within the web of bags.

Thereafter the web of bags is moved along the filling pipe 10, as shown in FIG. 10, with the outer cone being released to cover the pointed end of the inner cone and prevent damage to the web of bags. The flow of sterile air through the openings 74 facilitates movement of the web along the pipe, as does the presence of the tubes 62 through 72, which decreases surface contact between the web and the pipe.

Slitting apparatus (not shown) is positioned adjacent the ring 80 and as the boot and web of bags are moved dowstream along the filling pipe 10, the boot is first severed and removed. As indicated previously, the bags are preferably closed by a continuous longitudinally extending seal which intersects the seals 104. Thus the sterilized filling pipe is now positioned within the sterile web of bags without destroying the sterility of the pipe or the bags.

Thereafter and as described in detail in Applicant's above noted patents, the web of bags is moved along the filling pipe 10 and filling material is pumped out of the opening 32 to flow down into the individual bags 92, filling them with a desired quantity of the filling material 34. A fairly wide, longitudinally extending seal is then formed intersecting transverse seals 104 to seal the material within each of the bags. The channel forming portion of the web is then severed from the filled, sealed bags by a pair of cooperating, rotary shearing discs and the channel is then slit longitudinally to permit it to be removed from the filling pipe.

Of course when the end of a web of bags is reached a new web of bags may be fed onto the filling pipe in a similar manner to that described above, except that the end of the previous web of bags forms the enclosing means instead of the boot 76, and ordinarily there will be no need to first flush the pipe and tubes with a sterilizing agent such as steam.

Thus, it will be seen that the present invention provides method and apparatus for feeding a previously sterilized web of bags onto a filling pipe of a packaging machine without destroying the sterility thereof.

While the method and form of apparatus herein described constitute preferred embodiments of the invention, it is to be understood that the invention is not limited to this precise method and form of apparatus, and that changes may be made therein without departing from the scope of the invention.

What is claimed is:

1. A process for retaining asepsis of a sterile web of bags as said web of bags is fed onto a filling pipe of a packaging machine comprising:

sterilizing said filling pipe, attaching a leading end of a web of sterile bags to means enclosing said pipe at a point adjacent said upstream end of said pipe, sterilizing facing exterior surfaces of adjacent walls of said enclosing means and said web of bags at their point of attachment to each other, and puncturing said adjacent walls of said enclosing means and said web of bags with said upstream end of said pipe to position said upstream end of said pipe within said sterile web of bags.

2. The process of claim 1 wherein:

said filling pipe is pointed adjacent an upstream end thereof and said puncturing step comprises piercing said adjacent walls of said enclosing means and said web of bags with said pointed end of said filling pipe.

3. The process of claim 1 further comprising:

holding a wall of said web of bags opposite said wall thereof attached to said enclosing means spaced from said wall attached to said closing means as said adjacent walls are punctured.

4. The process of claim 1 further comprising:

blowing a sterile fluid into said web of bags at the point of puncture thereof to facilitate separation of opposing walls thereof.

5. The process of claim 1 further comprising:

blowing sterile fluid through openings along said filling pipe to facilitate movement of said web of bags along said filling pipe following said puncturing of said web of bags.

6. The process of claim 1 wherein said step of sterilizing facing exterior surfaces of adjacent walls of said enclosing means and said web of bags comprises:

positioning a sterilizing agent between said facing surfaces in contact therewith.

7. The process of claim 6 wherein said sterilizing step further comprises:

saturating an absorbent material with a fluid sterilizing agent and placing said absorbent material between and in contact with said facing surfaces.

8. The process of claim 1 further comprising:

holding a wall of said web of bags opposite said wall thereof attached to said enclosing means spaced from said wall thereof attached to said enclosing means as said adjacent walls are punctured, and blowing a sterile fluid into said web of bags at the point of puncture thereof.

* * * * *